US011566360B2

(12) United States Patent
Kim et al.

(10) Patent No.: US 11,566,360 B2
(45) Date of Patent: Jan. 31, 2023

(54) METHOD FOR CONTROLLING LAUNDRY PROCESSING APPARATUS

(71) Applicant: LG Electronics Inc., Seoul (KR)

(72) Inventors: Jihun Kim, Seoul (KR); Jihun Han, Seoul (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 16/965,860

(22) PCT Filed: Jan. 9, 2019

(86) PCT No.: PCT/KR2019/000311
§ 371 (c)(1),
(2) Date: Jul. 29, 2020

(87) PCT Pub. No.: WO2019/160245
PCT Pub. Date: Aug. 22, 2019

(65) Prior Publication Data

US 2021/0040666 A1 Feb. 11, 2021

(30) Foreign Application Priority Data

Feb. 13, 2018 (KR) ..... 10-2018-0018055

(51) Int. Cl.
*D06F 33/47* (2020.01)
*D06F 33/34* (2020.01)
(Continued)

(52) U.S. Cl.
CPC ..... *D06F 33/47* (2020.02); *D06F 33/34* (2020.02); *D06F 2103/00* (2020.02);
(Continued)

(58) Field of Classification Search
CPC ..... D06F 33/47; D06F 33/34; D06F 2103/00; D06F 2103/16; D06F 2103/18;
(Continued)

(56) References Cited

U.S. PATENT DOCUMENTS

2002/0032491 A1 3/2002 Imamura et al.
2002/0056293 A1 5/2002 Kim et al.
(Continued)

FOREIGN PATENT DOCUMENTS

KR 20020020982 3/2002
KR 20020037195 5/2002
(Continued)

OTHER PUBLICATIONS

Office Action in Korean Appln. No. 10-2018-0018055, dated Dec. 23, 2021, 13 pages (with English translation).

*Primary Examiner* — Michael E Barr
*Assistant Examiner* — Pallavi Chitta
(74) *Attorney, Agent, or Firm* — Fish & Richardson P.C.

(57) ABSTRACT

A method for controlling a laundry processing apparatus according to an embodiment of the present disclosure comprises steps of: inputting power to at least a second processing device and, through an input unit in the second processing device, inputting an installation inspection instruction for the second processing device; performing a primary inspection process by the installation inspection instruction; and performing a second inspection process after the primary inspection process is completed. In the primary inspection process, the control unit of the second processing device controls a plurality of inspections to proceed automatically in sequence, and the plurality of inspections may comprise at least two of a pairing inspection, a drawer closing state inspection, a drawer locking state inspection, and a lid closing state inspection.

5 Claims, 6 Drawing Sheets

(51) Int. Cl.

| | |
|---|---|
| *D06F 103/18* | (2020.01) |
| *D06F 103/40* | (2020.01) |
| *D06F 103/16* | (2020.01) |
| *D06F 103/00* | (2020.01) |
| *D06F 105/00* | (2020.01) |
| *D06F 105/52* | (2020.01) |
| *D06F 105/58* | (2020.01) |

(52) U.S. Cl.
CPC ..... *D06F 2103/16* (2020.02); *D06F 2103/18* (2020.02); *D06F 2103/40* (2020.02); *D06F 2105/00* (2020.02); *D06F 2105/52* (2020.02); *D06F 2105/58* (2020.02)

(58) Field of Classification Search
CPC ..... D06F 2103/40; D06F 2105/00; D06F 2105/52; D06F 2105/58; D06F 33/00
See application file for complete search history.

(56) References Cited

U.S. PATENT DOCUMENTS

| | | | | |
|---|---|---|---|---|
| 2013/0055770 | A1 | 3/2013 | Kim et al. | |
| 2013/0239336 | A1* | 9/2013 | Kim | D06F 33/34 8/137 |
| 2015/0345063 | A1* | 12/2015 | Sang | D06F 29/005 68/20 |
| 2017/0002498 | A1 | 1/2017 | Lee et al. | |
| 2018/0195223 | A1 | 7/2018 | Choi et al. | |
| 2018/0195224 | A1 | 7/2018 | Heo et al. | |

FOREIGN PATENT DOCUMENTS

| | | | |
|---|---|---|---|
| KR | 20060010999 | A * | 2/2006 |
| KR | 20130025265 | | 3/2013 |
| KR | 101458509 | B1 * | 11/2014 |
| KR | 20150137653 | | 12/2015 |
| KR | 20170002879 | | 1/2017 |
| KR | 20170002887 | | 1/2017 |
| KR | 20170002890 | | 1/2017 |
| KR | 20170033685 | | 3/2017 |

* cited by examiner

METHOD FOR CONTROLLING LAUNDRY PROCESSING APPARATUS

CROSS-REFERENCE TO RELATED APPLICATIONS

This application is a National Stage application under 35 U.S.C. § 371 of International Application No. PCT/KR2019/000311, filed on Jan. 9, 2019, which claims the benefit of Korean Patent Application No. 10-2018-0018055, filed on Feb. 13, 2018. The disclosures of the prior applications are incorporated by reference in their entirety.

TECHNICAL FIELD

The present disclosure relates to a method for controlling a laundry processing apparatus.

BACKGROUND ART

In general a laundry processing apparatus is a household appliance to wash or dry laundry containing clothing. For example, the laundry processing apparatus may include a washing machine and a dryer.

In addition, the laundry processing apparatus may be classified into a top-loading type, in which a laundry introduction port is formed in a top surface of the laundry processing apparatus, and a front-loading type in which the laundry introduction port is formed in a front surface of the laundry processing apparatus. In the top-loading type laundry processing apparatus, a rotation shaft of a drum, which rotates laundry, is formed vertically. In the front-loading type laundry processing apparatus, the rotation shaft of the drum extends horizontally.

Recently, there has been introduced a new-type laundry processing apparatus in which the top-loading type laundry processing apparatus and the front-loading type laundry processing apparatus are combined.

In detail, the laundry processing apparatus, which has been introduced recently, includes, so called, a "twin washing device" in which a second processing device in the top-loading type is placed under a first processing device in the front-loading type, as described in the following prior art.

The second processing device at the lower portion thereof includes a drum vertically placed to rotate, a tub receiving the drum, and the drum and the tub are withdrawn in a drawer type from the cabinet. Further, in the second processing device, the volume of the drum is smaller and used to wash a smaller amount of laundry.

In addition, the first processing device stacked on the top surface of the second processing device includes a drum having a rotation shaft disposed horizontally and a tub including the drum.

The first processing device and the second processing device are independently operable. In other words, any one of the first processing device and the second processing device does not receive power from a remaining one, but is connected to an independent power supply part such that the any one receives power from the remaining one. In addition, the first processing device and the second processing device are simultaneously or individually operable.

However, a circuit is used to supply power to a driving part of the second processing device only when the second processing device is stably stacked on the first processing device, for the safety of a product, and for preventing the second processing device from falling down due to the vibration during operation, In other words, a connection part and a switch structure disclosed in the prior art are provided in a power supply circuit or a communication circuit of the second processing device. In addition, a coupling part is provided on the bottom surface of the first processing device. The coupling part is designed to turn on the switch as the coupling part presses the connection part only when the first processing device is stably stacked on the top surface of the second processing device. In addition, when the switch is turned on, power or a command signal is transmitted to the driving part of the second processing device through a power supply circuit or a communication circuit of the second processing device.

When the laundry processing apparatus is installed in a laundry room, and the laundry processing apparatus is not sufficiently installed, various failures may occur.

For example, even though the first processing device is not normally stacked on the top surface of the second processing device, when an installation technician connects power cords of the first processing device and the second processing device and powers on, and when displays of the first processing device and the second processing device are lighted on, the installation technician may erroneously judge the installation as being normal. Accordingly, the installation technician may finish the installation work without an installation inspection.

In this case, since the laundry processing apparatus does not operate, a consumer determines a laundry processing apparatus as being out of order even though the laundry processing apparatus is not out of order. Accordingly, the consumer may inconveniently request the aid of the service center.

In addition, when the laundry processing apparatus is installed in the laundry room, a water supply failure in which washing water is not smoothly supplied as a water supply hose is twisted, bent, or pressed, a hose connection failure in which a hot water hose is connected to a cold hose connection part, a drain failure in which water is not smoothly drained as a drain hose is twisted, bent, pressed, or as a drain hose is bent higher than a drain pump, or a water supply and drain failure in which water leaks from a hose connection part, may occur in the procedure of installing the laundry processing apparatus.

The installation technician has to basically perform tests for the above items after installing the laundry processing apparatus in the installation place. Nevertheless, the installation technician often ignores the inspections because the installation technician doesn't know how to enter a test mode or thinks that he/she cannot temporarily afford to perform tests.

In addition, the installation technician may have a difficulty in being familiar with the test manner because there are many test items. In addition, there are many unnecessary test items, the installation technician may not sufficiently perform the tests.

DISCLOSURE

Technical Problem

The present disclosure is suggested to overcome the above-described problems.

In other words, the present disclosure provides a method for controlling a laundry processing apparatus, capable of automatically all inspection procedures as long as the installation technician inputs an installation inspection command even though an installation technician cannot memorize all installation inspection procedures described above, after installing the laundry processing apparatus, thereby reducing workload of the installation technician and reducing time spent for installation.

Technical Solution

In order to accomplish the above objects of the present disclosure, a method for controlling a laundry processing apparatus may include inputting power into at least the second processing device and inputting, into an input part provided in the second processing device, an installation inspection command for the second processing device, performing a primary inspection procedure in response to the installation inspection command, and subsequently performing a secondary inspection procedure after the primary inspection procedure is completed. A controller of the second processing device may perform a control operation such that a plurality of inspections are automatically performed in the primary inspection procedure in sequence, and the plurality of inspections may include at least two of a pairing inspection, a drawer close state inspection, a drawer lock state inspection, and a lid close state inspection.

Advantageous Effects

In order to accomplish the above objects of the present disclosure, a method for controlling a laundry processing apparatus may include inputting power into at least the second processing device and inputting, into an input part provided in the second processing device, an installation inspection command for the second processing device, performing a primary inspection procedure in response to the installation inspection command, and subsequently performing a secondary inspection procedure after the primary inspection procedure is completed. A controller of the second processing device may perform a control operation such that a plurality of inspections are automatically performed in the primary inspection procedure in sequence, and the plurality of inspections may include at least two of a pairing inspection, a drawer close state inspection, a drawer lock state inspection, and a lid close state inspection.

MODE FOR INVENTION

Hereinafter, a method for controlling a laundry processing apparatus will be described in detail with reference to accompanying drawings and flowcharts, according to an embodiment of the present disclosure.

Figure 1:
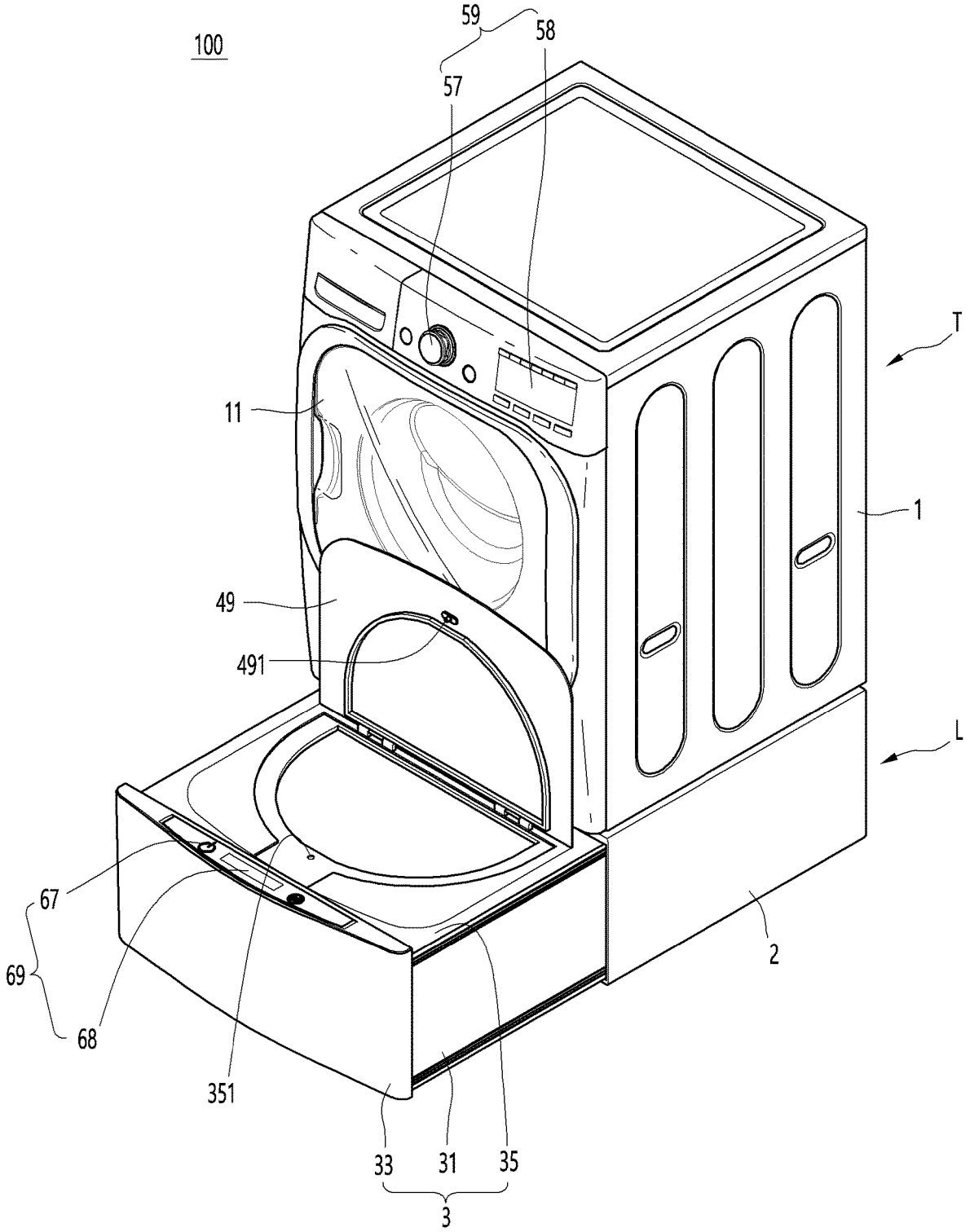
FIG. 1 is a perspective view illustrating a laundry processing apparatus for realizing a control method according to an embodiment of the present disclosure.

FIG. 1 is a perspective view illustrating a stack-type laundry processing apparatus in which a control method according to an embodiment of the present disclosure is realized.

Referring to FIG. 1, a laundry processing apparatus 100, in which a control method according to an embodiment of the present disclosure is realized, may have substantially the same structure as that of a laundry processing apparatus disclosed in the prior art.

In detail, the laundry processing apparatus 100 may include a first processing device 'I' at an upper portion thereof and a second processing device 'L' at a lower portion thereof. In addition, the first processing device 'T' may be a front-loading type laundry processing apparatus, and the second processing device 'L' may be a top-loading type laundry processing apparatus.

In more detail, the first processing device 'T' may include a first cabinet 1 forming an outer appearance and having a hexahedral shape, a first door 11 provided in a front surface of the first cabinet 1, and a first control panel 59 corresponding to an upper portion of the first door 11 and provided on the front surface of the first cabinet 1.

In addition, although not illustrated, as described in the prior art, the first cabinet 1 may be provided therein with a first tub in which washing water is filled, and a first drum provided in the first tub and containing laundry. A rotation shaft of the first drum may be formed to maintain level in a front-rear direction of the first cabinet 1 or to be inclined such that a front end portion thereof is higher than a rear end portion.

In addition, the first control panel 59 may include a first input part 57 to input various commands including operating conditions, and a first display part 58 to display washing related information including the state of washing in progress. The first input part 57 may include a power button, a start button, and a washing mode input button. The shape of the first input part 57 may be selected from a mechanical push button, a jog shuttle, or a touch pad.

In addition, a detergent input part, which is to introduce detergent, may be provided next to the first control panel 59. However, the positions at which the first control panel 59 and the detergent input part are formed, and the designs of the first control panel 59 and the detergent input part may be variously designed depending on products. Accordingly, the present disclosure is not limited to the shape disclosed in the drawing.

In addition, a left side or a right side of the first door 11 is rotatably connected to the front surface of the first cabinet 1 to selectively open a front opening of the first drum.

Meanwhile, the second processing device 'L' may include a second cabinet 2 forming an outer appearance and having a hexahedral shape, a drawer 3 provided to be slidably introduced into or withdrawn out of the second cabinet 2, a second drum and a second tub provided in the drawer 3, and a lid 49 provided on a top surface of the drawer 3. A rotation shaft of the second drum may be vertically formed as disclosed in the prior art.

In addition, the drawer 3 may include a drawer body 31 having a hexahedral shape, a second door 33 provided vertically to a front surface of the drawer body 31, a second control panel 69 provided on a top surface of the second door 33, and a drawer cover 35 forming the top surface of the drawer body 31. The second control panel 69 may configured to be recognized by a user and to allow the user to input a command, even in the state that the drawer 3 is completely closed.

In addition, the lid 49 may be rotatably coupled to the drawer cover 35 to selectively open or close a laundry introduction port formed in the drawer cover 35. In other words, the user may rotate the lid 49 up and may introduce laundry into the drum.

In addition, the second control panel 69 may include a second input part 67 to input an operating command for the second processing device 'L', and a second display 68 to display various pieces of information including an operating state of the second processing device 'L'. The shape of the second input part 67 may be selected from a mechanical push button, a jog shuttle, or a touch pad, which is similar to the first input part 57.

In addition, the drawer body 31 may be formed in a rear end of a top surface thereof with a water supply port, and a water supply hose may be connected to the water supply port.

In addition, pairing means is provided on the top surface of the second cabinet 2 and the bottom surface of the first cabinet 1. Accordingly, when the first cabinet 1 is exactly seated on the second cabinet 2, the second processing device 'L' may be driven.

In this case, in the present disclosure, the term "pairing" refers to that the first processing device 'T' is normally mounted on the top surface of the second processing device 'L', and the pairing means refers to a part to perform a function allowing the first processing device 'T' to be normally mounted at a right position on the top surface of the second processing device 'L'.

In addition, when the pairing is normally achieved, the center of the first processing device 'T' is vertically aligned in line with the center of the second processing device 'L', thereby minimizing the vibration of the first processing device and the falling-down probability of the first processing device, which may be caused by vibration generated in a washing procedure.

In addition, the pairing should be normally achieved to operate the second processing device 'L'.

In addition, the first processing device 'T' is not limited to the front-load laundry processing apparatus. For example, the first processing device 'T' may be the top-loading laundry processing apparatus in the same shape as that of the second processing device 'L'.

Figure 2:
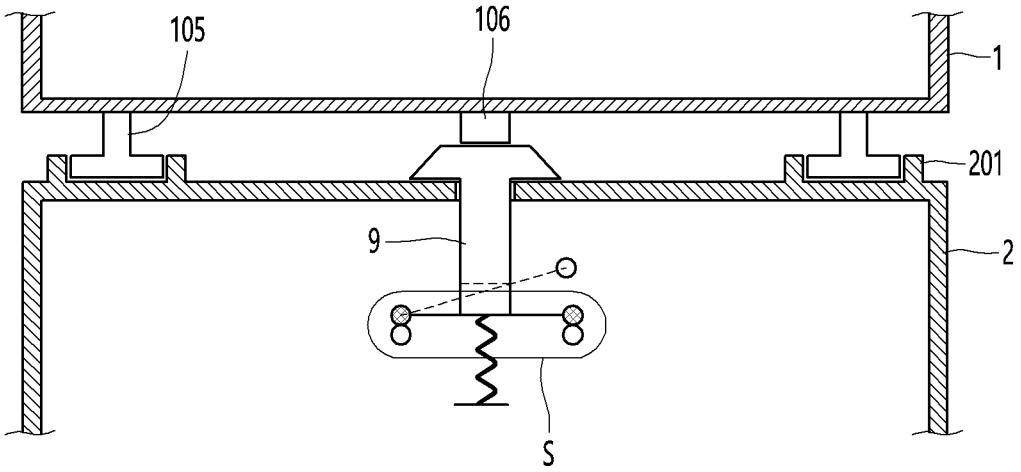
FIG. 2 is a partial sectional view schematically illustrating paring means according to an embodiment of the present disclosure.

FIG. 2 is a partial sectional view schematically illustrating paring means of a laundry processing apparatus, according to an embodiment of the present disclosure.

Referring to FIG. 2, a support leg 105 protrudes from each of four corners of the bottom surface of the first processing device 'T'. The second processing device 'L' is formed in each of four corners of the top surface thereof with a leg receiving part 201 to receive the support leg 105. The four support legs 105 are seated in the four leg receiving parts 201, respectively, thereby preventing the first processing device 'T' from moving due to vibration in the state that the first processing device 'T' is seated on the top surface of the second processing device 'L'.

However, the size of the leg receiving part 201 may be greater than the area of a cross-sectional bottom surface of the support leg 105 based on an installation tolerance. Accordingly, even if all the four support legs 105 are seated in the four leg receiving parts 201, the center of the first processing device 'T' is not completely coincident with the center of the second processing device 'L'.

In detail, the pairing means may include a connection part 9 provided in the second cabinet 2 to be elevatable, a pressing member 106 protruding from a bottom surface of the first cabinet 1 to press the connection part 9, and a connection switch 'S' which is selectively turned on or off as the connection part 9 moves up and down.

When the first processing device 'T' is seated on the second processing device 'L', the pressing member 106 presses the connection part 9 to move down the connection part 9. Then, the connection part 9 turns on the connection switch 'S'. In addition, an elastic member is connected to the connection part 9. Accordingly, when external force is not applied to the connection part 9, the connection part 9 receives force in a direction of further protruding from the top surface of the cabinet 2, and the connection switch 'S' is maintained to be turned off.

In other words, the pressing member 106 and the connection part 9 are mechanical means to turn on or off the connection switch 'S'.

Figure 3:
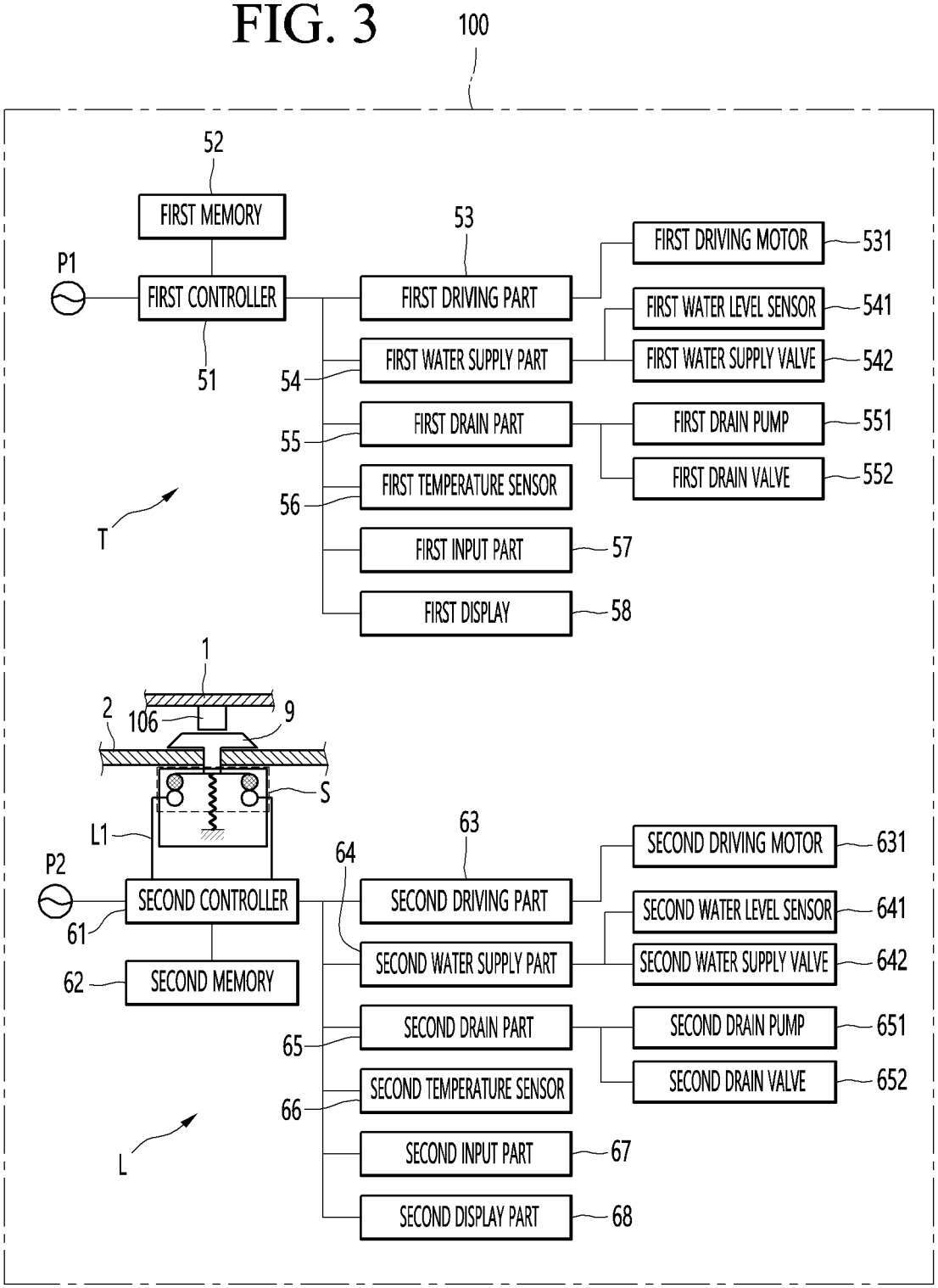
FIG. 3 is a control block diagram illustrating a laundry processing apparatus including pairing means according to an embodiment of the present disclosure.

FIG. 3 is a control block diagram illustrating a laundry processing apparatus including pairing means according to an embodiment of the present disclosure.

Referring to FIG. 3, according to an embodiment of the present disclosure, the first processing device 'T' constituting the stack-type laundry processing apparatus 100 may include a first controller 51, a first display 58, and a first memory 52.

In addition, the first processing device 'T' may further include a first driving part 53, a first water supply part 54, and a first drain part 55. The first driving part 53 may include a first driving motor 531 to rotate the first drum.

In addition, the first water supply part 54 may include a first water level sensor 541 to sense an internal water level of the first drum, and a first water supply valve 542 to selectively open or close a water supply fluid passage connected to the first drum.

In addition, the first drain part 55 may include a first drain pump 551 to drain washing water filled in the first drum and the first drain pump 552 to selectively open or close a drain fluid passage.

In addition, the first processing device 'T' may further include a first temperature sensor 56 to sense an internal water temperature of the first drum and a first input part 57 to input an operating command of the first processing device 'T'. Further, as described above, the first display 58 and the input part 57 may be formed on the first control panel 59. In addition, the first controller 51 may be provided on a printed circuit board (PCB) of the first control panel 59.

In addition, the first processing device 'T' is connected to a first power supply part 'P1' to receive supply power for operation. In other words, when a power cord provided in the first processing device 'T' is connected to the first power supply part 'P1', power is supplied the first processing device 'T' such that the first processing device 'T' is in an operable state.

Meanwhile, the second processing device 'L' may include a second controller 61, a second display 68, a second memory 62, a second driving part 63, a second water supply part 64, a second drain part 65, a second temperature sensor 66, and a second input part 67, which is similar to the first processing device 'T'. In addition, the second input part 67, the second display 68, and the second controller 61 may be provided on the second control panel 69.

The second driving part 63 may include a second driving motor 631 to rotate the second drum.

In addition, the second water supply part 64 may include a second water level sensor 641 to sense an internal water level of the second drum, and a second water supply valve 642 to selectively open or close a water supply fluid passage connected to the second drum.

In addition, the second drain part 65 may include a second drain pump 651 to drain washing water filled in the second drum, and a second drain pump 652 to selectively open or close a drain fluid passage connected to the second drum.

In addition, the connection switch 'S' and the second controller 61 may be connected to each other through an independent circuit separately provided for power supply and/or signal transmission/reception. Accordingly, when the connection switch 'S' is turned on by the pairing means, a closed-loop circuit is formed. In this case, the second controller 61 senses this and output a control signal for the operation of the second processing device 'L'. Even if power is supplied to the second processing device 'L' in the state that the connection switch 'S' is turned off, the second controller 61 may be designed to prevent a control signal for the operation from being output.

In addition, the second processing device 'L' is connected to a second power supply part 'P2' to receive supply power to operate. In other words, when a power cord provided in the second processing device 'L' is connected to the second power supply part 'P2', power is supplied to the second processing device 'L' such that the second processing device 'L' becomes in an operable state. In this case, the first power supply 'P1' and the second power supply 'P2' have the same connection point of the power cord, and the same supply power source input into a premise.

Meanwhile, as the pairing means is provided in the first processing device 'I' and the second processing device 'L', when a laundry processing apparatus produced in another manufacturing company is stacked on the second processing device 'L', the second processing device 'L' fails to operate.

To independently use only the second processing device 'L' in the state that the first processing device 'I' is not stacked on the second processing device 'L', an additional pressing member may be mounted to turn on the connection switch 'S' by pressing the connection part 9.

Figure 4:
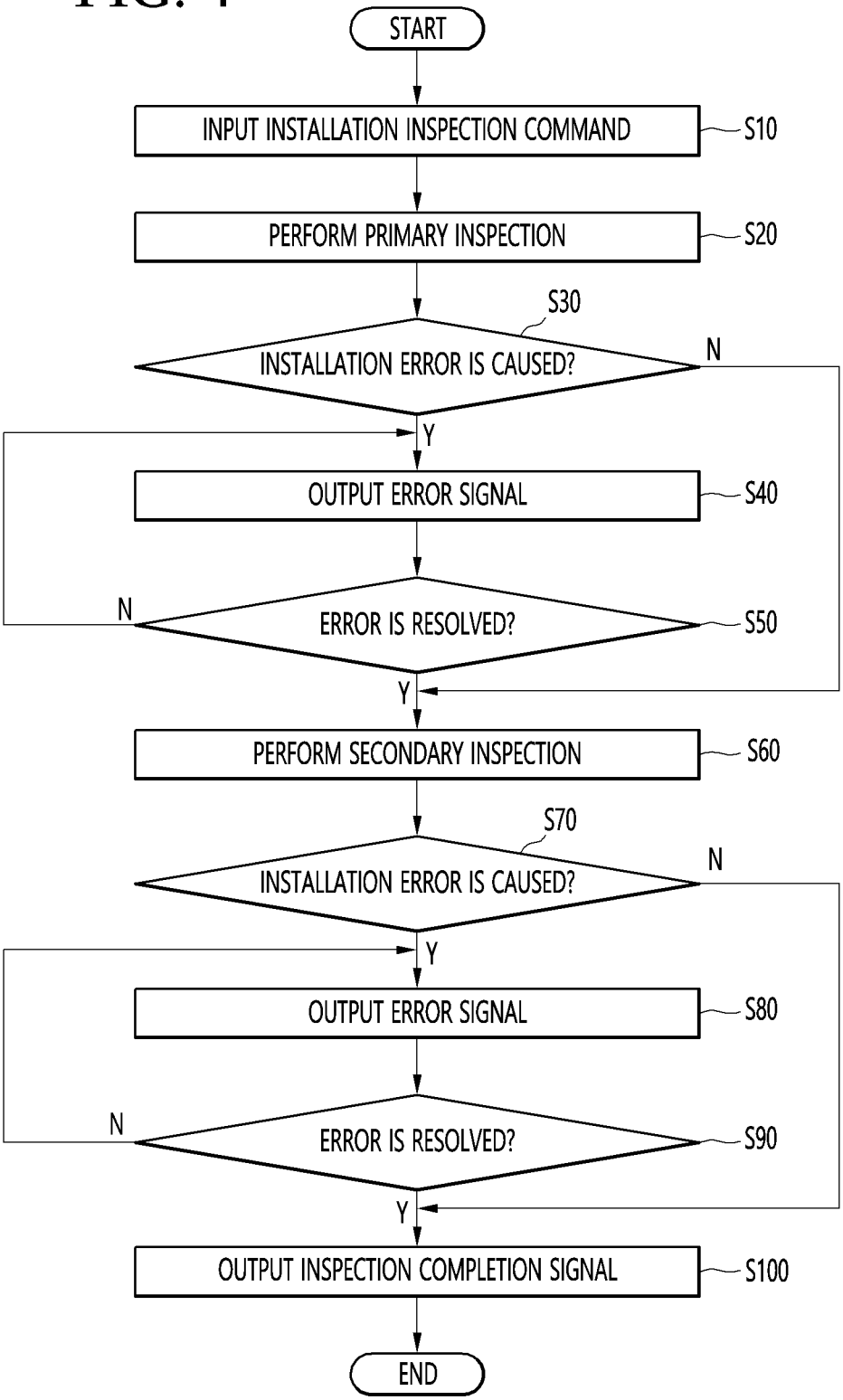
FIG. 4 is a flowchart illustrating an installation inspection method of a second processing device constituting a laundry processing apparatus according to an embodiment of the present disclosure.

FIG. 4 is a flowchart illustrating an installation inspection method of a second processing device constituting a laundry processing apparatus according to an embodiment of the present disclosure.

Referring to FIG. 4, an installation technician inspects whether an installation is normally achieved after the first processing device 'T' is stacked on the top surface of the second processing device 'L'. In other words, the installation technician executes an "installation inspection mode" to automatically check whether the installation is normally performed, before actually operating the laundry processing apparatus after installing the laundry processing apparatus.

In addition, an installation inspection command for the first processing device 'T' is input through the first input part 57 and an installation inspection command of the second processing device 'L' is input through the second input part 67, so the installation inspections of the devices are mutually independently performed. Accordingly, the installation technician may first perform the installation inspection for any one of the first processing device 'T' and the second processing device 'L', and then perform the installation inspection for a remaining one.

In detail, the installation technician seats the first processing device 'T' on the second processing device 'L', and connects the power cord to the power supply part such that power is applied to each of the first processing device 'T' and the second processing device 'L'. Then, power is supplied to each processing device to activate the first display 58 and the second display 68.

When the installation technician wants to first perform the installation inspection for the second processing device 'L', the installation technician inputs an installation inspection command by operating an input button provided in the second input part 67 (S10).

In detail, the installation inspection command, which refers to a command to start the "installation inspection mode", may be issued by separately providing a button dedicated for an installation inspection mode in the input part 67, or by operating at least two of a plurality of input parts for other operating commands simultaneously or with a time difference, such that the installation inspection mode is performed.

It is preferred that the installation inspection mode is used by utilizing existing command input buttons, rather than providing the separate input button, because the installation inspection mode is hardly used except that the laundry processing apparatus is installed at the initial stage. This is identically applicable to the first processing device 'T'.

When the installation inspection command is input, the second controller 61 allows a primary inspection procedure to be performed (S20). In addition, it is determined whether an installation error is caused in the primary inspection procedure (S30). When the installation error is determined as being caused, an error signal is allowed to be output through the second display (S40). When the error is determined as being resolved (S50) or when the error is not caused, a secondary inspection procedure is subsequently performed (S60).

If the error caused in the primary inspection procedure is not solved through a work by the installation technician, the inspection procedure is not allowed any more in the state that the error signal is output.

Meanwhile, it is determined whether an installation error is caused even in the secondary inspection procedure (S70). When the installation error is caused, an error signal is output (S80). When the error is determined as being resolved (S90) or not determined as being caused, an inspection completion signal is output (S100) and the installation inspection mode is terminated.

The primary inspection procedure described above is performed with respect to only the second processing device 'L', and the secondary inspection procedure may be identically performed with respect to the first processing device 'T'. The details of the primary inspection procedure and the secondary inspection procedure will be described in more detail below.

Figure 5:
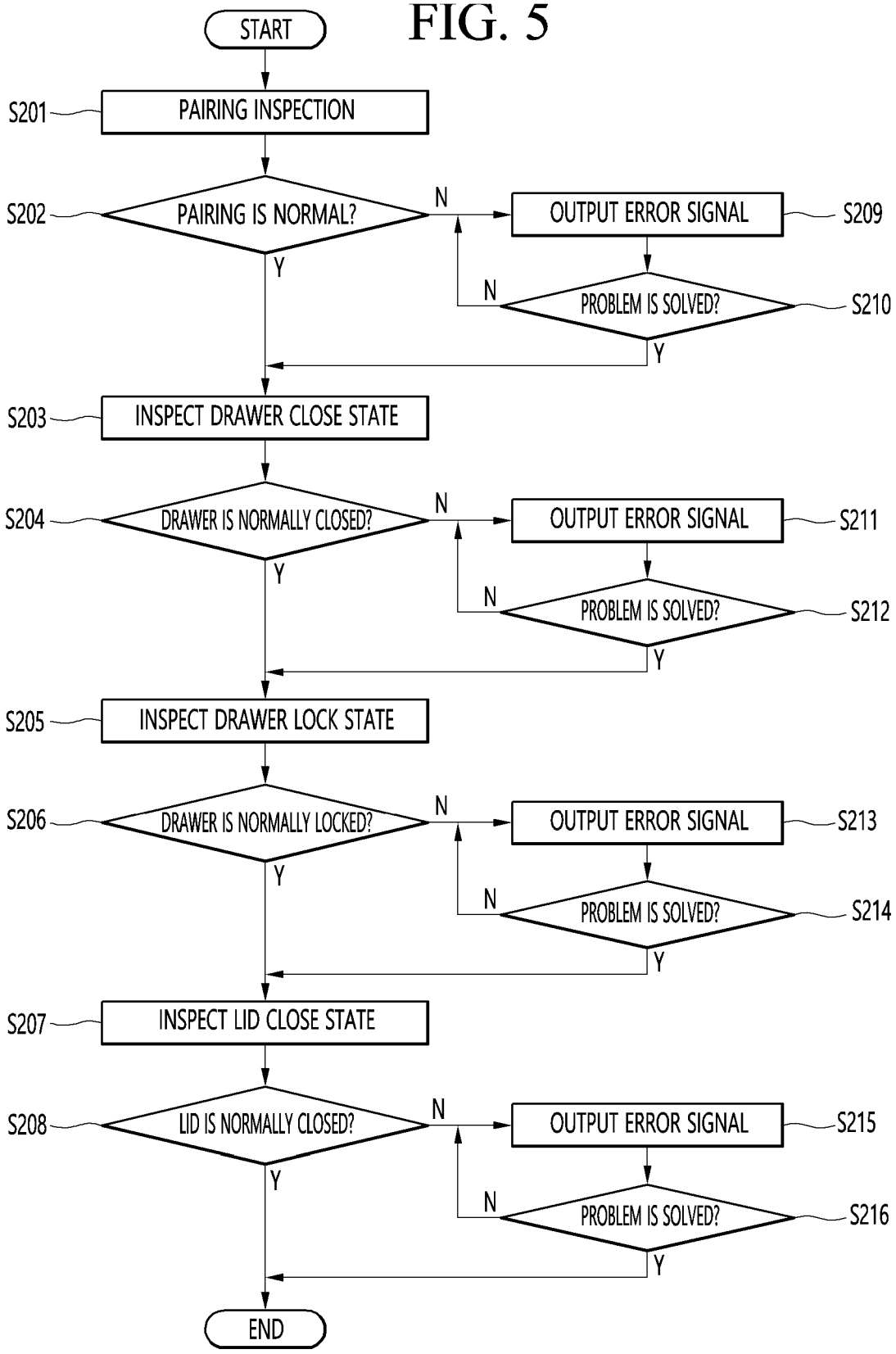
FIG. 5 is a flowchart illustrating a primary inspection procedure performed in an installation inspection mode.

FIG. 5 is a flowchart illustrating a primary inspection procedure performed in an installation inspection mode.

Referring to FIG. 5, when the installation inspection command is input and the primary inspection procedure is started, the above-described pairing inspection procedure is first performed (S201). In other words, it is determined whether the first processing device 'T' is normally seated on the top surface of the second processing device 'L' and the second processing device 'L' is enabled to operate. When the pairing is not normally achieved, even if the display of the second processing device 'L' is powered on, the operation of the second processing device 'L' is disabled.

Accordingly, the second controller 61 determines whether the pairing is normally achieved (S202). When the pairing is not determined as being normally achieved, the second controller 61 outputs an error signal (S209).

Meanwhile, when it is determined that the pairing is normally achieved or when it is determined that the pairing work is re-performed by the installation technician after outputting the error signal, so a problem is solved (S210), a procedure of inspecting a drawer close state is performed (S203).

In this case, the error signal may be continuously output in the form of a text or a moving picture through the second display 68 or in a sound form through a speaker provided in the second processing device 'L', until the pairing is normally achieved by the installation technician.

The procedure (S203) of inspecting the drawer close state is to determine whether the drawer 3 provided in the second processing device 'L' is completely inserted into the second cabinet 2. In other words, the procedure is to determine whether the rear surface of the second door 33 provided in the front surface of the drawer 3 is inserted until the rear surface of the second door 33 makes completely contact with the front surface of the second cabinet 2.

In detail, a door switch (not illustrated) is provided on the front surface of the second cabinet 2. When the second door 33 is completely closed, the door switch is turned on, and an on-signal of the door switch is transmitted to the second controller 61.

When the second door 33 is not completely closed, the second controller 61 outputs an error signal (S211). In addition, when the second door 33 is completely closed by the installation technician, so the problem is solved (S212) or when the second door 33 is completely closed from the beginning, the procedure of inspecting a drawer lock state is performed (S205).

In the procedure of inspecting the drawer lock state, it is determined whether driving means normally operates to perform a function of locking or unlocking the drawer. For example, a locking motor may be provided at a substantially central portion inside the second door 33, a gear assembly may be mounted on a rotation shaft of the locking motor, and a pair of rods may be connected to the gear assembly. In addition, when the locking motor is rotated, the pair of rods move in a left-right direction of the second cabinet 2 while moving in opposite directions, thereby performing an operation of locking or unlocking the second door 3.

In more detail, when a door lock commands input in the state that the drawer 3 is completely closed, each of end portions of the pair of rods, that is, an end portion opposite to the end portion connected to the gear assembly protrudes from the lateral side of the drawer body 31 and is inserted into an insertion groove provided in the lateral side of the second cabinet 2. In addition, a switch is provided into the insertion groove, and is turned on by the end portion of the rod inserted into the insertion groove such that a door lock signal may be transmitted to the second controller 61. For reference, drawer locking and door locking should be interpreted as having the same meaning, and drawer closing and door closing should be interpreted as having the same meaning.

When the driving means to lock or unlock the door fails to normally operate, a door lock signal may not be transmitted to the second controller 61 even after the door lock commands input. Accordingly, when a lock signal is not received within a set time after a drawer lock command is output from the second controller 61 in the procedure of inspecting the drawer lock state, a drawer locking function is determined as being abnormal and an error signal is output (S213)

When the drawer is normally locked (S206) or the problem is solved by the installation technician (S214), a next step, that is, a procedure of inspecting a lid close state is performed (S207).

In the procedure of inspecting the lid close state, it is inspected whether a lid is normally closed, which is similar to the procedure of inspecting the drawer close state (S203). In other words, it is not determined that a latch 491 provided on a bottom surface of a front end portion of the lid 49 is completely inserted into the latch groove 351 formed in the top surface of the drawer cover 35, the second controller 61 outputs an error signal (S215). When it is determined that a problem is solved by the installation technician (S216) or that the lid 49 is normally closed, the second controller 61 terminates the primary inspection procedure and performs the secondary inspection procedure.

In this case, the pairing inspection, the drawer close state inspection, the drawer lock state inspection, and the lid close state inspection are not limited to the sequences illustrated in the flowchart of FIG. 5. In other words, the sequence to perform the four inspection procedures may be differently set.

Figure 6:
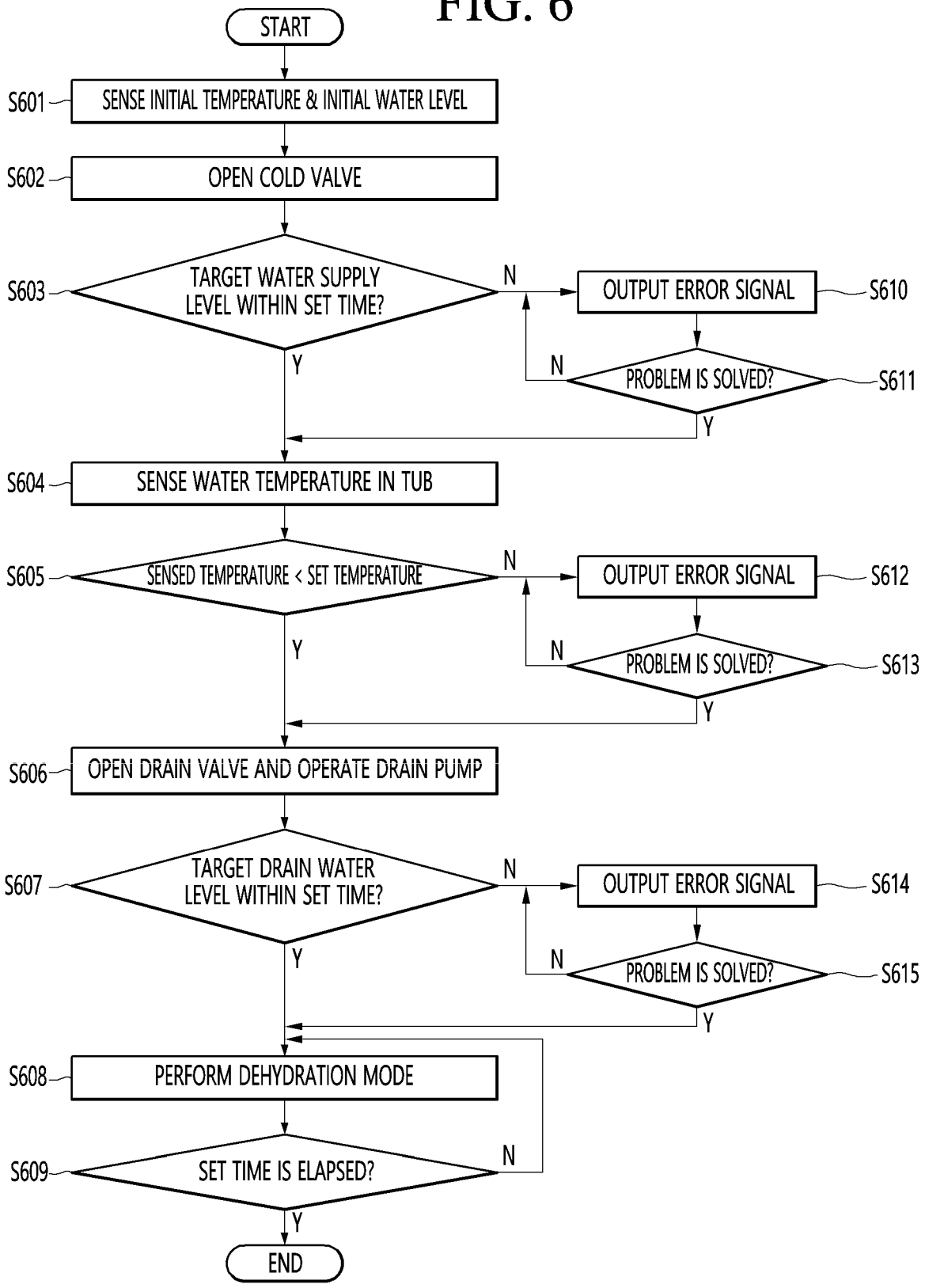
FIG. 6 is a flowchart illustrating a secondary inspection procedure performed in an installation inspection mode.

FIG. 6 is a flowchart illustrating a secondary inspection procedure performed in an installation inspection mode.

In detail, the secondary inspection procedure is identically performed even with respect to the first processing device 'T'.

Referring to FIG. 6, in the secondary inspection procedure, an initial temperature and an initial water level inside the drum of the second processing device 'L' are sensed (S601). The reason for sensing the initial water level is why water is not completely drained in the process of being drained after water is supplied to the second tub for product inspection in the process of manufacturing a product, and water may be remained to some extent in the second tub at a time point in which the product is released. In this case, a target water supply level needs to be adjusted by a controller. For example, on the assumption that a set water level is 'a' under the condition that water is not remained in the tub, when the water level of remaining water in the tub is 'b', a target set water level may be adjusted to 'a+b' by the controller.

In addition, a cold valve is open (S602) such that cold water is supplied into the second tub. Then, it is determined whether the supplied cold water reaches the target water supply level within a set time (S603).

Determining whether the supplied cold water reaches the target water supply level within the set time may be an example of a method of determining whether a set amount of water is supplied within the set time.

When it is determined that the supplied cold water reaches the target water supply level within the set time, a procedure of sensing an internal water temperature of the tub is performed to sense the temperature of supplied washing water (S604). To the contrast, when the supplied cold water fails to reach the target water supply level within the set time, an error signal is output (S610).

That the supplied cold water fails to reach the target water supply level within the set time is because the washing water is not smoothly supplied as a water supply hose is bent or pressed, or as the water pressure at the installation place is significantly low. Accordingly, when the error signal is output, the installation technician may check the connection state of the water supply hose or the water pressure.

When the problem is solved as the connection state of the water supply hose is adjusted to a normal state by the installation technician (S611), the step of sensing the internal water temperature of the tub (S604) is performed.

In the step of sensing the internal water temperature of the tub, the temperature of washing water supplied to the tub is sensed by the second temperature sensor 66. Then, it is determined whether the sensed temperature is lower than the set temperature (S605), and when the sensed temperature is higher than the set temperature, an error signal is output (S612). The phenomenon in which the temperature of the supplied water is higher than the set temperature may occur when a hot water hose is incorrectly connected to a cold water supply port of the second processing device 'L'. According, the second controller 61 outputs an error signal indicating that the water supply hose is incorrectly connected.

Meanwhile, when the installation technician solved the problem by connecting the hot water hose connected to the cold water supply port to a hot water supply port, and connecting the cold water hose connected to the hot water supply port to the cold water supply port (S613), or when the sensing temperature is determined as being lower than the set temperature, the step of inspecting a drain state is performed.

To check the drain state, the controller opens the drain valve and operates the drain pump (S606). In addition, the second water level sensor 641 may sense whether the internal water level of the tub is lowered to a target drain water level within a set time. For reference, although the above description has been made in that the water level sensor is a component of the water supply part, the water level sensor may sense the drain water level as well as the water supply level.

In detail, when it is determined that the internal water level of the tub fails to reach a target water level within the set time, an error signal is output (S614). When the problem is solved by the installation technician (S615) or when the water level reaches the target drain water level within the set time, a next step is performed.

The situation that the internal water level of the tub fails to reach the target drain water level within the set time may include the case that the water is not smoothly drained as a drain hose is bent or pressed, the case that a problem is caused in the drain pump, or the case that an outlet of the drain hose or a part bent upward is positioned higher than the drain pump or a present water level, so the drain is interrupted. Accordingly, when an error signal is output in the procedure of inspecting the drain state, the installation technician may check the state of the drain hose or the state of the drain pump to solve the problem. Then, the procedure of inspecting the drain state is performed through the second input part 67.

Meanwhile, when the procedure of inspecting the drain state is finished, the first driving motor 531 is driven in the second controller 61 such that a dehydration mode is performed during a set time (S608). When the set time is elapsed (S609), the driving of the driving motor 631 is stopped and then the secondary inspection procedure is terminated.

An inspection completion signal indicating inspection completed is displayed on the second display 68, before the secondary inspection procedure is terminated, which is similar to the primary inspection procedure (S100).

In the dehydration mode, the second driving motor 631 rotates at the maximum speed. The reason for performing the dehydration mode in the final step after the procedure of inspecting the drain state is to determine whether the second driving motor 631 is smoothly operated or whether there is vibration and noise for the laundry processing apparatus 100.

When the problem is caused in the second driving motor 631, the second driving motor 631 fails to rotate at the maximum speed. In addition, when the installation surface of the laundry processing apparatus 100 is not flat, the vibration or noise may be excessively caused. In this case, the installation technician stops the second driving motor 631 by manually turning off the power of the laundry processing apparatus, adjusts the installation state of the laundry processing apparatus 100, or checks the state of the second driving motor 631.

Meanwhile, in FIGS. 5 and 6, to perform a next step as an error signal is output and then the problem is solved, the installation technician identifies the problem, takes an action to solve the problem, and re-performs the same inspection by pressing a specific button, for example, a start button, thereby automatically performing the next step.

Alternatively, the installation technician takes an action to solve the problem and then presses a specific button, for example, a completion button or an OK button, such that a signal indicating that the problem is solved is input into the second controller 61, thereby performing the next inspection procedure.

In the case of the pairing inspection, when the pairing is normally achieved by the installation technician, the connection switch is turned on and the on-signal is transmitted to the controller. Accordingly, the installation technician does not need to input the signal indicating that the problem is solved.

As described above, when the controller may determine that the problem is solved, a next inspection procedure may be automatically performed.

In addition, the secondary inspection procedure may be identically applied even to the first processing device 'T'. In other words, when the installation technician presses a button provided in the first input part 57 to perform the installation inspection mode, the secondary inspection procedure may be automatically performed.

In addition, after the installation inspection procedure is completed any one of the first processing device 'T' and the second processing device 'L' is completed, the installation inspection procedure may be allowed with respect to a remaining installation procedure may be performed. When installation inspections for the two processing devices are simultaneously performed, error signals may be simultaneously output. Accordingly, the installation technician may be confused. Accordingly, it is preferred that an inspection is performed with respect to any one of the two processing devices and then performed with respect to a remaining one, which may reduce a mistake to be made by the installation technician due to the confusion of the installation technician. However, the present disclosure is not limited thereto. For example, the installation technician may simultaneously perform the inspections.

In addition, in the state that at least the primary inspection procedure of the primary inspection procedure and the secondary inspection procedure is not completed, even if the washing command is input through the second input part 67, the driving part may not operate.

For example, when the on-signal of the connection switch is not into the second controller 61 as the pairing is not normally achieved, the second controller 61 may prevent the operation of the second driving part 63.

In other words, when the error signal is output as a problem occurs in any one of a plurality of inspection steps performed in the primary inspection procedure, the operation of the driving part may not be performed.

The invention claimed is:

1. A method for controlling a laundry processing apparatus having a structure in which a first processing device including any one of a top-loading type and a front-loading type is stacked on a second processing device including the top-loading type, the method comprising:

inputting power into at least the second processing device and inputting, into an input part provided in the second processing device, an installation inspection command for the second processing device;

performing a primary inspection procedure in response to the installation inspection command; and subsequently performing a secondary inspection procedure after the primary inspection procedure is completed, wherein a controller of the second processing device performs a control operation such that a plurality of inspections are automatically performed in the primary inspection procedure in sequence, wherein the plurality of inspections include at least two of a pairing inspection, a drawer close state inspection, a drawer lock state inspection, and a lid close state inspection, wherein the secondary inspection procedure is performed with respect to the first processing device, when power is input into the first processing device and an installation inspection command for the first processing device is input, wherein the secondary inspection procedure includes:

sensing an initial temperature and an initial water level in a tub, and opening a cold water valve and sensing a water level in the tub, wherein a first error signal is output, when the water level in the tub fails to reach a target water supply level within a first set time, wherein a temperature of washing water supplied into the tub is sensed, when the water level in the tub reaches the target water supply level within the first set time, wherein an error signal is output when the sensed temperature is higher than a set temperature, wherein the method further comprises:

opening a drain valve, when the sensed temperature is lower than the set temperature, operating a drain pump, and sensing the water level in the tub, wherein an error signal is output, when the water level in the tub fails to reach a target drain water level within a second set time, wherein a dehydration mode is performed, when the water level in the tub reaches the target drain water level within the second set time, wherein a driving motor, which is configured to rotate a drum, rotates at a maximum speed for a third set time in the dehydration mode, and wherein the secondary inspection procedure is completed when a fourth set time is elapsed.

2. The method of claim 1, wherein an error signal is output when a problem is caused in the primary and secondary inspection procedures, and wherein the primary and secondary inspection procedures are stopped until a problem-solved signal is input into the controller.

3. The method of claim 2, wherein the problem-solved signal includes a switch-on signal generated when a connection switch is turned on in the pairing inspection, and wherein the controller automatically performs a next inspection, when the switch-on signal is transmitted to the controller.

4. The method of claim 2, wherein the problem-solved signal includes an input signal input through the input part after the problem is solved, and wherein a relevant inspection procedure is re-performed, when the problem-solved signal is input.

5. The method of claim 2, wherein the problem-solved signal includes an input signal input through the input part after the problem is solved, and wherein a next inspection is performed, when the problem-solved signal is input.

* * * * *